US012024965B2

(12) United States Patent
El Mallawany

(10) Patent No.: US 12,024,965 B2
(45) Date of Patent: Jul. 2, 2024

(54) SINGLE TRIP, DEBRIS TOLERANT LOCK MANDREL WITH EQUALIZING PRONG

(71) Applicant: Halliburton Energy Services, Inc., Houston, TX (US)

(72) Inventor: Ibrahim El Mallawany, Dhahran (SA)

(73) Assignee: Halliburton Energy Services, Inc., Houston, TX (US)

( * ) Notice: Subject to any disclaimer, the term of this patent is extended or adjusted under 35 U.S.C. 154(b) by 110 days.

(21) Appl. No.: 17/839,159

(22) Filed: Jun. 13, 2022

(65) Prior Publication Data

US 2023/0399906 A1 Dec. 14, 2023

(51) Int. Cl.
*E21B 23/02* (2006.01)

(52) U.S. Cl.
CPC ..... *E21B 23/02* (2013.01)

(58) Field of Classification Search
CPC ..... E21B 23/02; E21B 34/14
See application file for complete search history.

(56) References Cited

U.S. PATENT DOCUMENTS 2,871,947 A 2/1959 Fredd
RE25,289 E * 11/1962 Fredd ..... E21B 23/02 166/126
3,642,070 A 2/1972 Taylor et al.
3,856,081 A 12/1974 Canalizo
4,522,259 A * 6/1985 Akkerman ..... E21B 23/02 166/217
4,883,121 A 11/1989 Zwart
7,111,677 B2 * 9/2006 St. Clair ..... E21B 34/101 166/135
8,474,542 B2 7/2013 Blanton et al.
8,596,350 B2 * 12/2013 Fay ..... E21B 23/02 166/216
8,651,182 B2 * 2/2014 Fay ..... E21B 23/02 166/208
2004/0206513 A1 * 10/2004 St. Clair ..... E21B 23/02 166/386
2012/0012338 A1 * 1/2012 Blanton ..... E21B 23/02 166/217

(Continued)

OTHER PUBLICATIONS

International Search Report and Written Opinion for International Patent Application No. PCT/US2022/034739 dated Mar. 10, 2023.

*Primary Examiner* — Jennifer H Gay
(74) *Attorney, Agent, or Firm* — Scott Richardson; C. Tumey Law Group PLLC

(57) ABSTRACT

A system includes a tool mandrel securable to a landing nipple and a prong receptacle coupled to a lower end of the tool mandrel. The prong receptacle includes a central bore and a pressure release port in communication with the central bore. The system also includes an equalizing prong initially securable within the tool mandrel in a run-in position. Further, the system includes a tubular prong extension coupled to the equalizing prong. An upper end of the tubular prong extension extends up out of the tool mandrel. Moreover, axially downward movement of the tubular prong extension from the run-in position to a set position secures the tool mandrel to the landing nipple, and axially upward movement of the tubular prong extension from the set position to a released position disengages the tool mandrel from the landing nipple.

20 Claims, 7 Drawing Sheets

(56) References Cited

U.S. PATENT DOCUMENTS

| | | | | |
|---|---|---|---|---|
| 2012/0186805 | A1* | 7/2012 | Fay | E21B 23/02 166/240 |
| 2012/0186806 | A1* | 7/2012 | Fay | E21B 23/02 166/240 |
| 2022/0081993 | A1 | 3/2022 | Chevallier et al. | |
| 2022/0081994 | A1 | 3/2022 | Chevallier et al. | |

* cited by examiner

SINGLE TRIP, DEBRIS TOLERANT LOCK MANDREL WITH EQUALIZING PRONG

BACKGROUND

After drilling a wellbore in a subterranean formation for recovering hydrocarbons such as oil and gas lying beneath the surface, wellbore completion systems may be introduced into the wellbore to control production. For example, lock mandrels may be run-in-hole to provide a setting point for flow-control devices such as equalizing prongs. Equalizing prongs may be run-in-hole to selectively plug the wellbore at the lock mandrel. Installing the lock mandrels and equalizing prongs may be a time-consuming process, which may increase costs of completion operations.

Further, retrieving current lock mandrels is generally problematic in wellbores with heavy debris. Traditionally, during a retrieval process, a retrieving tool is run-in-hole and inserted into an inner diameter (ID) of a corresponding lock mandrel to secure the retrieving tool to their corresponding lock mandrel. The retrieving tool may generally include an actuatable feature that expands to interface with an inner surface and/or lip of a fishing neck of the corresponding lock mandrel. With the fishing neck engaged, the retrieving tool may pull the lock mandrel uphole. Unfortunately, wellbore debris may move into the inner diameter of a lock mandrel and block entry and/or engagement of the retrieving tool with the lock mandrel.

BRIEF DESCRIPTION OF THE DRAWINGS

These drawings illustrate certain aspects of some of the embodiments of the present disclosure and should not be used to limit or define the method.

DETAILED DESCRIPTION

Disclosed herein are systems and methods to plug a wellbore using a single-trip, debris-tolerant lock mandrel with equalizing prong. The system and method may incorporate an equalizing prong and/or prong extension secured to a lock mandrel in such a manner that both may be run-in-hole, set, and optionally retrieved all in the same trip. Moreover, the downhole locking system includes a tubular prong extension to mitigate issues associated with downhole debris during retrieval. The disclosed use of a prong and prong extension make the system very debris tolerant compared to legacy systems that require insertion of a retrieving tool deep into a potentially debris-laden mandrel to equalize pressure and release.

Figure 1:
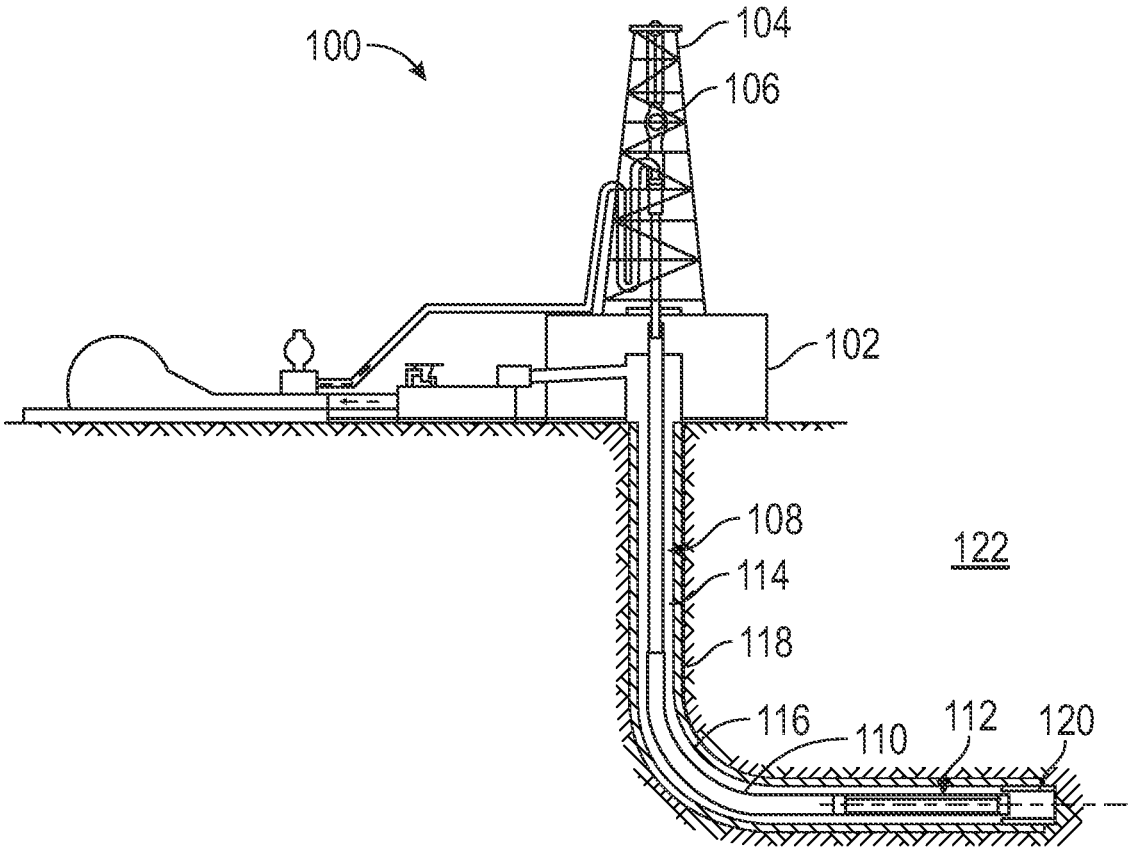
FIG. 1 illustrates a side elevation, partial cross-sectional view of an operational environment for a drilling and completion system, in accordance with some embodiments of the present disclosure.

FIG. 1 illustrates a side elevation, partial cross-sectional view of an operational environment for a drilling and completion system in accordance with one or more embodiments of the disclosure. It should be noted that while FIG. 1 generally depicts a land-based drilling and completion assembly, those skilled in the art will readily recognize that the principles described herein are equally applicable to subsea drilling and completion operations that employ floating or sea-based platforms and rigs, without departing from the scope of the disclosure. As illustrated, the drilling and completion assembly 100 includes a platform 102 that supports a derrick 104 having a traveling block 106 for raising and lowering a tool string, e.g., a work string 110 on a conveyance 108. The work string 110 supports a system, referred to herein as a downhole locking system 112, used to set and retrieve a lock mandrel for plugging a wellbore 114, along with any other suitable tools. The conveyance 108 may include a tubing string, wireline, slick line, coil tubing, or other suitable conveyance for supporting the downhole locking system 112.

During completion operations, the work string 110 lowers the downhole locking system 112 into the wellbore 114. As illustrated, the wellbore 114 may be lined with casing 116 cemented to a wellbore wall 118 to protect the wellbore 114 from failure (e.g., collapse, erosion) and to provide a fluid path for hydrocarbons during production. In some embodiments, the wellbore 114 may have completion tubing (not shown), disposed interior the casing 116, to assist with production. The completion tubing and/or the casing 116 may include at least one landing nipple 120 to provide a landing location for subsurface flow control equipment (e.g., the downhole locking system 112) and restrain further downhole movement of the downhole locking system 112.

Accordingly, the work string 110 may lower the downhole locking system 112 into a wellbore 114 until the downhole locking system lands on the landing nipple 120. As set forth in detail below, the downhole locking system 112 may be further driven, via downhole movement of the work string 110, to a set position after landing on the landing nipple 120 to secure the downhole locking system 112 to the landing nipple 120, as well as to plug or block uphole flow of fluid (e.g., hydrocarbons) through the downhole locking system 112. The downhole locking system 112 may be secured to the landing nipple 120 and plugged in a single trip. Additionally, uphole movement of the work string 110, after setting the downhole locking system 112, may release the downhole locking system 112 from the set position.

Figure 2:
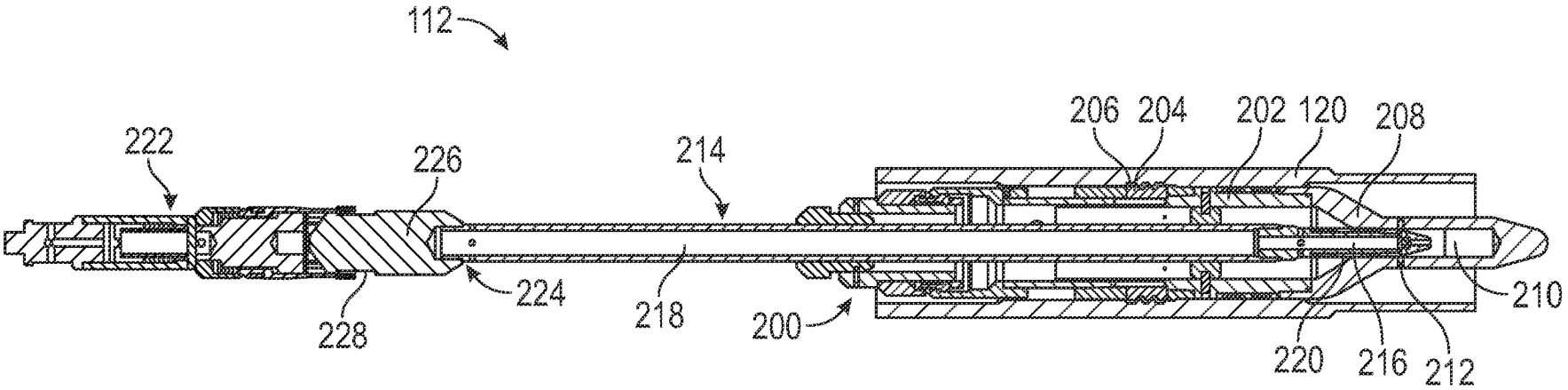
FIG. 2 illustrates a cross-sectional view of a downhole locking system, in accordance with some embodiments of the present disclosure.

FIG. 2 illustrates a cross-sectional view of the downhole locking system 112, in accordance with some embodiments of the present disclosure. As set forth above, the downhole locking system 112 is run-in-hole to the landing nipple 120 as part of completion operations. The downhole locking system 112 includes a lock mandrel 200 that expands to a set position to secure the downhole locking system 112 to the landing nipple 120. In particular, the lock mandrel 200 comprises a tool mandrel 202 that is securable to the landing nipple 120 via at least one key 204 disposed about the tool mandrel 202 that expands radially into a corresponding key slot 206 of the landing nipple 120. Moreover, the lock mandrel 200 comprises a prong receptacle 208 coupled to a lower end of the tool mandrel 202. The prong receptacle 208 has a central bore 210 and a pressure release port 212 in communication with the central bore 210. As the downhole locking system 112 is run-in-hole and/or retrieved, fluid may pass through the pressure release port 212.

However, the downhole locking system 112 further includes a prong 214 that plugs or blocks uphole flow of fluid through the pressure release port 212 in the set position such that the downhole locking system 112 may control fluid flow through the wellbore 114. The prong 214 comprises an equalizing prong 216 and a tubular prong extension 218 coupled to the equalizing prong 216. The prong 214 may be oriented with the equalizing prong 216 positioned downhole from the tubular prong extension 218. Further, the equalizing prong 216 may be disposed within the tool mandrel 202 and/or the prong receptacle 208 proximate the pressure release port 212 of the prong receptacle 208. In the illustrated embodiment, the downhole locking system 112 is in the run-in-position such that a prong seal 220 of the equalizing prong 216 is offset from the pressure release port 212. However, in the set position (shown in FIG. 4), the equalizing prong 216 slides axially downward such that the prong seal 220 is axially aligned with the pressure release port 212 and plugs or blocks uphole flow of fluid through the pressure release port 212.

Additionally, the prong 214 may drive expansion of the lock mandrel 200. In the run-in position, the prong 214 is releasably secured to the lock mandrel 200. However, as set forth in greater detail below, continued force on the prong 214 from the work string 110 and/or conveyance 108 (shown in FIG. 1), after landing the lock mandrel 200, may release the prong 214 to slide axially. Axial movement of the prong 214 with respect to the lock mandrel 200 may drive the at least one key 204 to the set position with the at least one key 204 radially expanded into the corresponding key slot 206 of the landing nipple 120.

The work string 110 may exert the continued force on the prong 214 via a setting and retrieving tool 222 releasably coupled to an upper end 224 of the tubular prong extension 218. As illustrated, an upper end 224 of the tubular prong extension 218 extends up out of the lock mandrel 200. As illustrated, about forty-five percent of a total length of the tubular prong extension 218 may extend axially uphole from the lock mandrel 200 (e.g., from an uphole end 356 of an inner connector sleeve 320 of the lock mandrel 200) in the run-in position. However, any suitable amount between twenty percent to eighty percent of the total length of the tubular prong extension 218 may extend axially uphole from the lock mandrel 200 in the run-in position. Alternatively, less than twenty percent or more than eighty percent of the total length of the tubular prong extension 218 may extend axially uphole from the lock mandrel 200 in the run-in position. Generally, at least twenty percent of the total length of the tubular prong extension 218 must extend axially uphole from the lock mandrel 200 in the run-in position such that a sufficient amount the tubular prong extension 218 remains axially uphole from the lock mandrel 200 in the set position so that the setting and retrieving tool 222 may releasably couple to an external portion of the tubular prong extension 218. Moreover, a maximum of eighty precent of the total length of the tubular prong extension 218 may extend axially uphole from the lock mandrel 200 in the run-in position such that a sufficient amount of the tubular prong extension 218 is positioned within the lock mandrel 200 so that the equalizing prong 216, coupled to the tubular prong extension 218, may be appropriately positioned to plug or block uphole flow of fluid through the pressure release port 212 in the set position.

Moreover, the setting and retrieving tool 222 may be releasably coupled to the upper end 224 of the tubular prong extension 218 via a coupling feature 226. As illustrated, the downhole locking system 112 may include a coupling feature 226 rigidly secured to the upper end 224 of the tubular prong extension 218. For example, the coupling feature 226 may be threaded to the upper end 224 of the tubular prong extension 218. Moreover, an exterior surface 228 of the coupling feature 226 is engageable with the setting and retrieving tool 222. Indeed, the setting and retrieving tool 222 may couple to the exterior surface 228 of the coupling feature 226 to drive axial movement of the prong 214. In particular, the setting and retrieving tool 222 may drive coupling feature 226 axially downhole to move the tubular prong extension 218 and equalizing prong 216 to the set position. Further, the setting and retrieving tool 222 may pull the coupling feature 226 axially uphole a first distance to disengage the equalizing prong 216 from the pressure release port 212. Additionally, as set forth in greater detail below, the setting and retrieving tool 222 may further pull coupling feature 226 axially uphole a second distance to disengage the tool mandrel 202 from the landing nipple 120 and move the tubular prong extension 218 to the released position.

Figure 3:
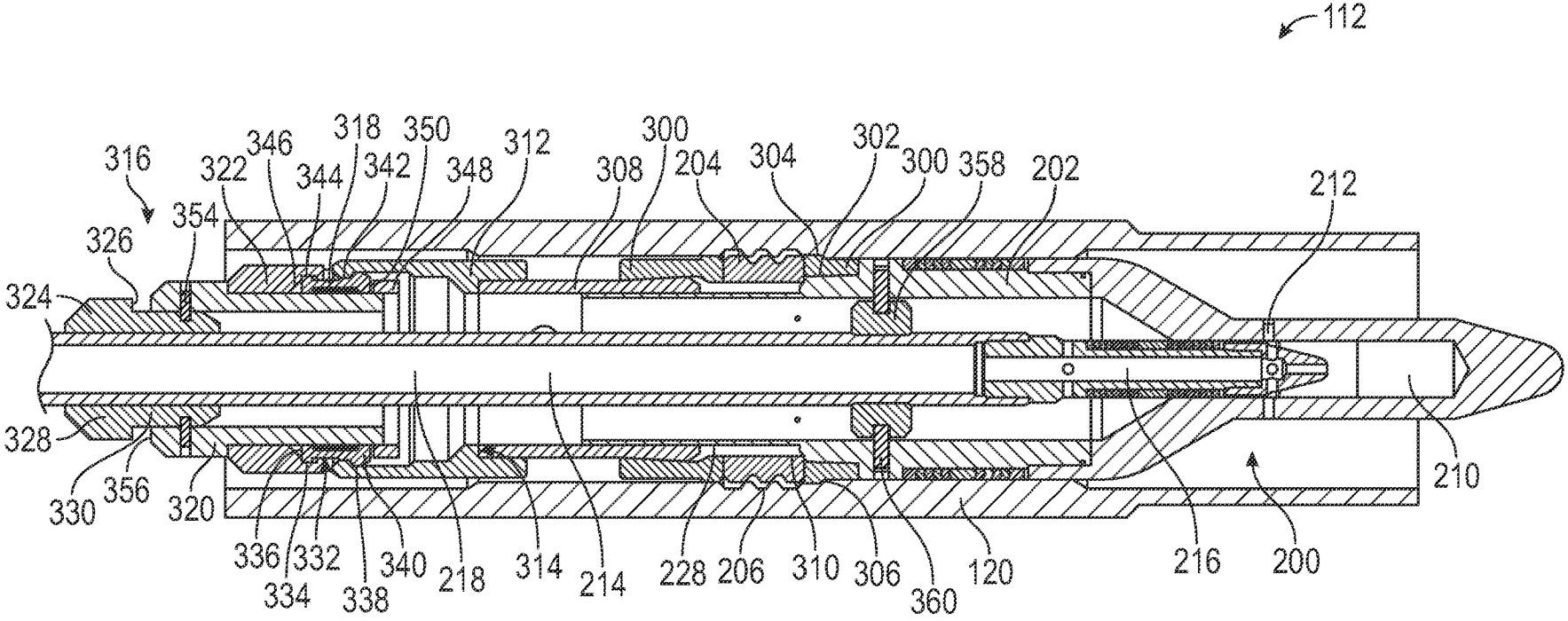
FIG. 3 illustrates a cross-sectional view of a downhole locking system in a run-in position, in accordance with some embodiments of the present disclosure.

FIG. 3 illustrates a cross-sectional view of a downhole locking system 112 in a run-in position, in accordance with some embodiments of the present disclosure. As illustrated, the downhole locking system 112 is in the run-in position as the lock mandrel 200 and prong 214 are run-in-hole toward the landing nipple 120 by the downhole movement of the setting and retrieving tool 222 (shown in FIG. 2). In the run-in position, the prong 214 is axially secured to the lock mandrel 200. The downhole locking system 112 remains in the run-in position until force exerted from the setting and retrieving tool 222 on the prong 214, with the lock mandrel 200 landed on the landing nipple 120, shears the prong 214 from the lock mandrel 200 such that the prong 214 is released to axially move with respect to the lock mandrel 200.

The lock mandrel 200 comprises the tool mandrel 202, as well as a key retainer 300. In the illustrated embodiment, the tool mandrel 202 is landed on the landing nipple 120 via the key retainer 300. In some embodiments, the tool mandrel 202 may be landed directly on the landing nipple 120. However, any suitable portion of the lock mandrel 200 may be landed on the landing nipple 120. Moreover, the key retainer 300 is secured to an exterior surface 302 of the tool mandrel 202. The key retainer 300 may be rigidly secured to the tool mandrel 202 such that restraining movement of the key retainer 300 may also restrain movement of the tool mandrel 202. In some embodiments, the key retainer 300 may be threaded to the tool mandrel 202. Further, as illustrated, the key retainer 300 may have a key shoulder 304 that engages a no-go shoulder 306 of the landing nipple 120. Engaging the no-go shoulder 306 with the key shoulder 304 may restrain downhole movement of the tool mandrel 202 with respect to the landing nipple 120 (e.g., land the tool mandrel 202 on the landing nipple 120).

Further, the key retainer 300 is configured to house the at least one key 204. The at least one key 204 may be housed in the key retainer 300 such that the at least one key 204 may actuate radially inward and radially outward with respect to the tool mandrel 202. As set forth above, the at least one key 204 actuates radially outward into the corresponding key slot 206 in the landing nipple 120 to secure the tool mandrel 202 to the landing nipple 120 in a set position. However, as illustrated, the at least one key 204 is disposed in a radially inward position with respect to the tool mandrel 202 in the run-in position of the downhole locking system 112, such that the at least one key 204 is retracted entirely or mostly retracted into the key retainer 300.

The lock mandrel 200 further includes an expander sleeve 308 that actuates the at least one key 204 radially outward as the downhole locking system 112 moves from the run-in position to the set position. The expander sleeve 308 is axially slidable along the tool mandrel 202 and at least partially positioned radially between the exterior surface 228 of the tool mandrel 202 and radially interior surfaces of the key retainer 300 and the at least one key 204. In the run-in position, the expander sleeve 308 is axially offset from the at least one key 204. In particular, the expander sleeve 308 is positioned axially uphole from the at least one key 204 in the run-in position. However, the expander sleeve 308 is configured to slide axially downward toward the at least one key 204 as the downhole locking system 112 moves to the set position, such that the expander sleeve 308 contacts a radially interior surface 310 of the at least one key 204 to drive the at least one key 204 radially outward into the corresponding key slot 206.

The lock mandrel 200 further includes a fishing neck 312 coupled to an upper end 314 of the expander sleeve 308. The fishing neck 312 may be rigidly coupled to the expander sleeve 308 such that axial movement of the fishing neck 312 may drive axial movement of the expander sleeve 308. In some embodiments, the fishing neck 312 may be threaded to the expander sleeve 308. However, any suitable fastening may be used to couple the fishing neck 312 to the expander sleeve 308.

The lock mandrel 200 may further include a connector assembly 316 secured to the expander sleeve 308 such that movement of the connector assembly 316 drives the expander sleeve 308 to slide axially along the tool mandrel 202. For example, axially downhole movement of the connector assembly 316 may drive the expander sleeve 308 axially downward toward the at least one key 204. In the illustrated embodiment, the connector assembly 316 is secured to the expander sleeve 308 via the fishing neck 312. That is, the connector assembly 316 may be indirectly secured to the expander sleeve 308. Further, in some embodiments, the connector assembly may not be secured to the expander sleeve. Instead, the connector assembly 316 may be configured to contact the fishing neck 312 and/or the expander sleeve 308 such that axial movement of the connector assembly 316 drives the expander sleeve 308 to slide axially. The downhole locking system 112 may include any suitable linkage such that axial movement of the connector assembly 316 drives axial movement of the expander sleeve 308.

As illustrated, the connector assembly 316 may include an outer connector sleeve 318, an inner connector sleeve 320, and a connector retainer 322. In some embodiments, the connector assembly 316 may comprise additional components. Further, in some embodiments, various components of the connector assembly 316 and/or the fishing neck 312 may be combined, or the various components may be formed into a single component. For example, the outer connector sleeve 318, the inner connector sleeve 320, and the connector retainer 322 may be a single component. In another example, the outer connector sleeve 318, the inner connector sleeve 320, the connector retainer 322, and the fishing neck 312 may be a single component.

The inner connector sleeve 320 of the connector assembly 316 is secured to the tubular prong extension 218 in the run-in position. As set forth in greater detail below, the inner connector sleeve 320 may be secured to the tubular prong extension 218 via an upper prong sleeve 324 that is secured about the tubular prong extension 218. Moreover, the inner connector sleeve 320 may have a substantially cylindrical shape. In the illustrated embodiment, the inner connector sleeve 320 comprises a uniform inner diameter along an axial length of the inner connector sleeve 320. A radially outer surface of the inner connector sleeve 320 may have a variable diameter. For example, in the illustrated embodiment, the radially outer surface includes an upper prong shoulder 326 formed at an interface between an upper portion 328 of the upper prong sleeve 324 and a lower portion 330 of the upper prong sleeve 324. As illustrated, the upper portion 328 may have a larger diameter than the lower portion 330 such that the upper prong shoulder 326 is formed at the interface or transition to the smaller diameter of the lower portion 330.

The outer connector sleeve 318 of the connector assembly 316 is disposed about the inner connector sleeve 320. As illustrated, the outer connector assembly 316 has an annular shape with an annular recess 332 formed in a radially outer surface of the outer connector assembly 316. The annular recess 332 may define an upper lip 334 at an upper end 336 of the outer connector assembly 316 and a lower lip 338 at a lower end 340 of the outer connector assembly 316. As illustrated, the lower lip 338 may interface with a corresponding fishing lip 342 of the fishing neck 312. The inner connector sleeve 320 may be configured to pull the fishing neck 312 axially upward via the interface between the lower lip 338 and the fishing lip 342 as the downhole locking system 112 transitions from the set position to the released position.

Moreover, the connector assembly 316 comprises the connector retainer 322, which may also be disposed about the inner connector sleeve 320. Further, the connector retainer 322 may be rigidly secured to the inner connector sleeve 320. For example, the connector retainer 322 may be threaded onto the inner connector sleeve 320. Alternatively, the connector retainer 322 may be welded or otherwise fastened to the inner connector sleeve 320. Moreover, the connector retainer 322 has an inner profile 344 for at least partially housing the outer connector sleeve 318. The inner profile 344 may extend radially outward with respect to the inner connector sleeve 320 such that a gap 346 is formed between the inner connector sleeve 320 and the surface of the inner profile 344. The upper end 336 of the outer connector sleeve 318 may be housed in said gap 346. Further, the inner profile 344 may extend radially inward proximate a lower end 348 of the connector retainer 322 such that a retainer lip 350 is formed to restrain axial movement of the outer connector sleeve 318 with respect to the connector retainer 322. Additionally, the connector retainer 322 may have an upper retainer shoulder 352 that interfaces with an upper end of the fishing lip 342 of the fishing neck 312. Indeed, the connector assembly 316 may be configured to drive the fishing neck 312 axially downward as the downhole locking system 112 transitions from the run-in position to the set position via the upper retainer shoulder 352 of the connector retainer 322. Accordingly, the upper retainer shoulder 352 of the connector retainer 322 and the lower lip 338 of the outer connector sleeve 318 may secure or connect the connector assembly 316 to the fishing neck 312 and/or the expander sleeve 308.

Moreover, as set forth above the downhole locking system 112 comprises the tubular prong extension 218 that is coupled to the equalizing prong 216, and that extends up out of the tool mandrel 202. Further, the tubular prong extension 218 is secured with the connector assembly 316. In particular, the tubular prong extension 218 is secured to inner connector sleeve 320 of the connector assembly 316 in the run-in position. As such, axially downward movement of the tubular prong extension 218 from the run-in position to a set position may drive the connector assembly 316 downhole to secure the tool mandrel 202 to the landing nipple 120 and move the equalizing prong 216 along the central bore 210 from the run-in position, having the pressure release port 212 of the prong receptacle 208 open, to the set position to block the pressure release port 212. Further, and wherein axially upward movement of the tubular prong extension 218 from the set position to a released position may pull the equalizing prong 216 uphole to open the pressure release port 212 and drive the connector assembly 316 uphole to pull the expander sleeve 308 axially uphole to retract the at least one key 204 such that the tool mandrel 202 disengages from the landing nipple 120.

As set forth above, the downhole locking system 112 further comprises the upper prong sleeve 324 secured about the tubular prong extension 218 and releasably secured to the connector assembly 316 in the run-in position. Specifically, the upper prong sleeve 324 may be releasably secured to the inner connector sleeve 320 of the connector assembly 316 via at least one upper shear member 354. As illustrated, the upper prong sleeve 324 may be disposed partially within the inner connector sleeve 320. However, in some embodiments, the upper prong sleeve 324 may be disposed entirely within the inner connector sleeve 320. Further, the upper prong sleeve 324 may include the upper prong shoulder 326 formed in the radially outer surface of the upper prong sleeve 324 at a transition between the upper portion 328 and a lower portion 330 of the upper prong sleeve 324. As illustrated, the upper prong shoulder 326 may be axially offset from an uphole end 356 of the inner connector sleeve 320 in the run-in position. Alternatively, the upper prong shoulder 326 may contact the uphole end 356 of the inner connector sleeve 320 in the run-in position. Additionally, the upper prong sleeve 324 may have an annular shape with a variable outer diameter. The lower portion 330 of the upper prong sleeve 324 may have an outer diameter that is smaller than the inner diameter of the inner connector sleeve 320 such that the lower portion 330 of the upper prong sleeve 324 may slide along a central bore of the inner connector sleeve 320. Further, an outer diameter of the upper portion 328 may be larger than the inner diameter of the inner connector sleeve 320.

Moreover, the downhole locking system 112 further comprises a lower prong sleeve 358 secured about the tubular prong extension 218 and releasably secured to the tool mandrel 202 in the run-in position. In particular, the lower prong sleeve 358 may be releasably secured to the tool mandrel 202 via at least one lower shear member 360. As illustrated, the lower prong sleeve 358 may be disposed downhole from the upper prong sleeve 324. Further, the lower prong sleeve 358 may be disposed within a central bore of the tool mandrel 202 in the run-in position. As such, an outer diameter of the lower prong sleeve 358 is smaller than an inner diameter of the tool mandrel 202. However, the outer diameter of the lower prong sleeve 358 may be larger than the inner diameter of the inner connector sleeve 320. In the illustrated embodiment, the lower prong sleeve 358 has a generally cylindrical shape. However, the lower prong sleeve 358 may have any suitable shape.

Figure 4:
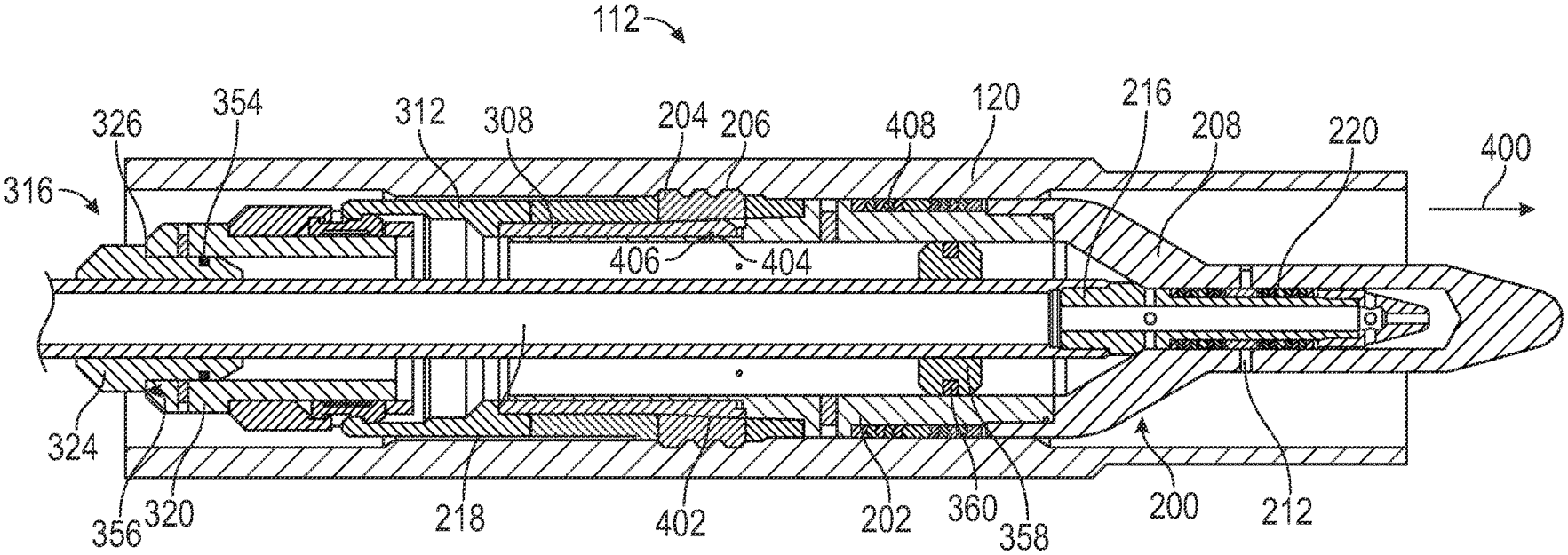
FIG. 4 illustrates a cross-sectional view of a downhole locking system in a set position, in accordance with some embodiments of the present disclosure.

FIG. 4 illustrates a cross-sectional view of a downhole locking system 112 in a set position, in accordance with some embodiments of the present disclosure. Axially downward movement of the tubular prong extension 218 from the run-in position to a set position drives the connector assembly 316 into the expander sleeve 308 such that the expander sleeve 308 slides axially downward to the set position and drives the at least one key 204 radially outward into the corresponding key slot 206. As illustrated, the at least one key 204 is disposed in the corresponding key slot 206 to secure the lock mandrel 200 to the landing nipple 120 in the set position. Moreover, in the set position, the equalizing prong 216 is positioned in the prong receptacle 208 such that the equalizing prong 216 blocks fluid flow through the pressure release port 212.

As set forth above, tubular prong extension 218 is releasably secured to the connector assembly 316 via the upper prong sleeve 324. Specifically, the upper prong sleeve 324 is secured to the tubular prong extension 218 via threading, welding, or other suitable fastenings, and the upper prong sleeve 324 is releasably secured to the connector assembly 316 (e.g., the inner connector sleeve 320) via the at least one upper shear member 354 in the run-in position (shown in FIG. 3). With the lock mandrel 200 landed on the landing nipple 120, axially downward movement of the tubular prong extension 218 shears the at least one upper shear member 354, which releases the tubular prong extension 218 and upper prong sleeve 324 to move axially with respect to the connector assembly 316. As such, axially downhole movement of the tubular prong extension 218 slides the upper prong sleeve 324 axially downward with respect to the connector assembly 316 and drives the upper prong shoulder 326 into the uphole end 356 of the inner connector sleeve 320, which drives the connector assembly 316 to move in the axially downhole direction 400.

As set forth above, the connector assembly 316 may be secured to the expander sleeve 308 directly or via the fishing neck 312 such that axially downward movement of the connector assembly 316 drives the expander sleeve 308 to move axially downward with respect to the tool mandrel 202. As illustrated, the expander sleeve 308 is driven to the set position having the expander sleeve positioned radially between the tool mandrel 202 and the at least one key 204. As the expander sleeve 308 moves to the set position, a radially outer surface 402 of the expander sleeve 308 pushes the at least one key 204 radially outward into the corresponding key slot 206 to secure the lock mandrel 200 to the landing nipple 120 in the set position.

The expander sleeve 308 may also include at least one setting shear member 404 for holding the expander sleeve 308 in the set position. The tool mandrel 202 may include at least one corresponding setting slot 406 for receiving the at least one setting shear member 404. In the run-in position, the setting shear member 404 may be held in a collapsed or retracted position. However, when the expander sleeve 308 moves into the set position, the setting shear member 404 may align with the setting slot 406 such that the setting shear member 404 may expand into the setting slot 406. A spring force may drive the setting shear member 404 into the setting slot 406 and hold the setting shear member 404 in the setting slot 406.

Moreover, the axially downward movement of the tubular prong extension 218 from the run-in position to a set position may also shear the at least one lower shear member 360 to detach or release the lower prong sleeve 358 from the tool mandrel 202. With the tubular prong extension 218 detached from the tool mandrel 202, the tubular prong extension 218 and the equalizing prong 216 may move axially downhole into the prong receptacle 208 and to the set position. In the set position, the equalizing prong 216 is positioned in the prong receptacle 208 such that the equalizing prong 216 blocks fluid flow through the pressure release port 212. As illustrated, the equalizing prong 216 may include a prong seal 220 to increase the effectiveness of the equalizing prong 216 in blocking fluid flow through the pressure release port 212. With the equalizing prong 216 blocking the pressure release port 212, the lock mandrel 200 may plug the wellbore 114 at the location of the landing nipple 120. In some embodiments, the tool mandrel 202 may also include a tool mandrel seal 408 to seal the tool mandrel 202 against the landing nipple 120 to increase the effectiveness of the lock mandrel 200 in plugging the wellbore 114.

Figure 5:
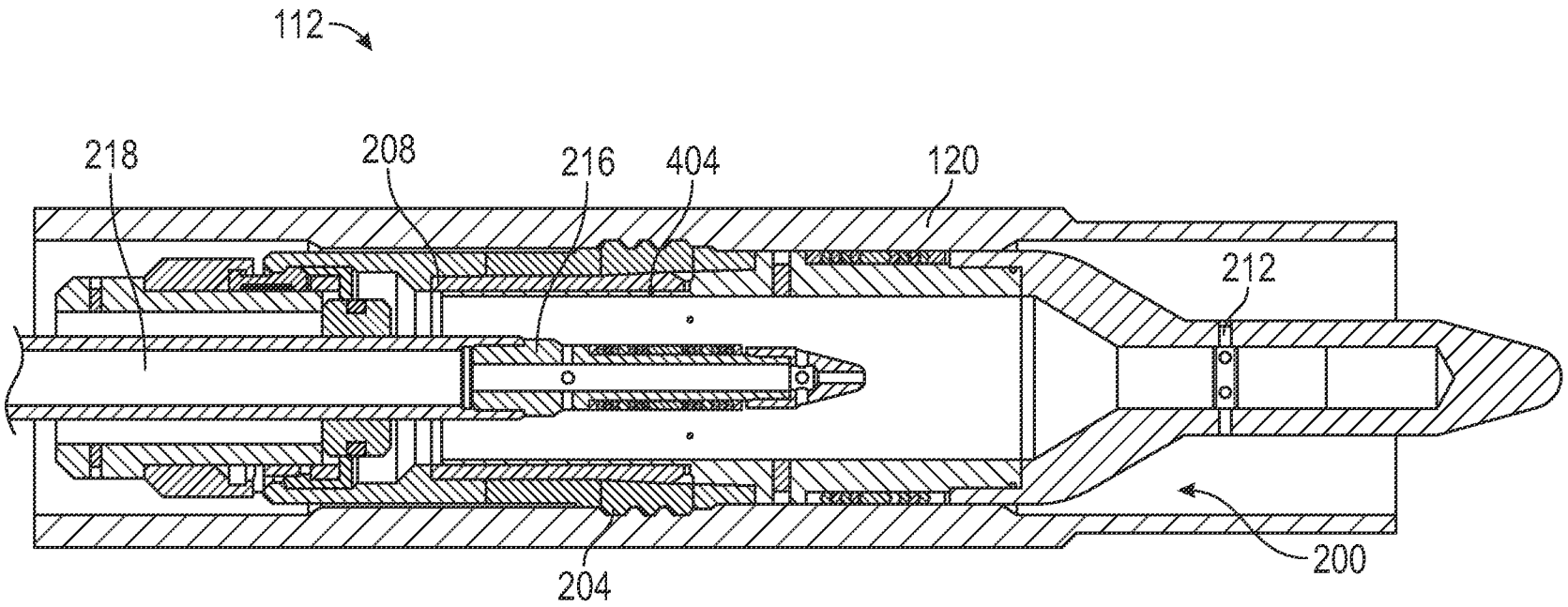
FIG. 5 illustrates a cross-sectional view of a downhole locking system in a pressure equalizing position, in accordance with some embodiments of the present disclosure.

FIG. 5 illustrates a cross-sectional view of a downhole locking system 112 in a pressure equalizing position, in accordance with some embodiments of the present disclosure. As set forth above, the lock mandrel 200 may plug the wellbore 114 (shown in FIG. 1) at the location of the landing nipple 120 in the set position. As such, significant pressure may build up downhole the lock mandrel 200 in the set position. Releasing the lock mandrel 200 from the landing nipple with a high-pressure differential across the lock mandrel 200 may cause damage to the downhole locking system 112 as the high pressure drives the lock mandrel 200 uphole from the landing nipple 120. Accordingly, the downhole locking system 112 may move to a pressure equalizing position before releasing the lock mandrel 200 from the landing nipple 120.

Specifically, the equalizing prong 216 may be pulled uphole by the setting and retrieving tool 222 (shown in FIG. 2) via the tubular prong extension 218 a first distance such that the equalizing prong 216 is pulled away from the pressure release port 212, which unseals the pressure release port 212. With the pressure release port 212 unsealed, the pressure differential across the lock mandrel 200 may start to equalize through the pressure release port 212. The downhole locking system 112 may be held in the equalizing position for any suitable amount of time such that uphole and downhole pressure, with respect to the lock mandrel 200, may at least partially equalize. For example, the downhole locking system 112 may be held in the equalizing position for 1-2 hours. However, the amount of time may vary based on a size of the pressure release port 212, as well as wellbore conditions.

Additionally, in the equalizing position, the expander sleeve 308 is held in place with the at least one setting shear member 404 such that the at least one key 204 remains actuated or expanded to secure the lock mandrel 200 to the landing nipple 120.

Figure 6:
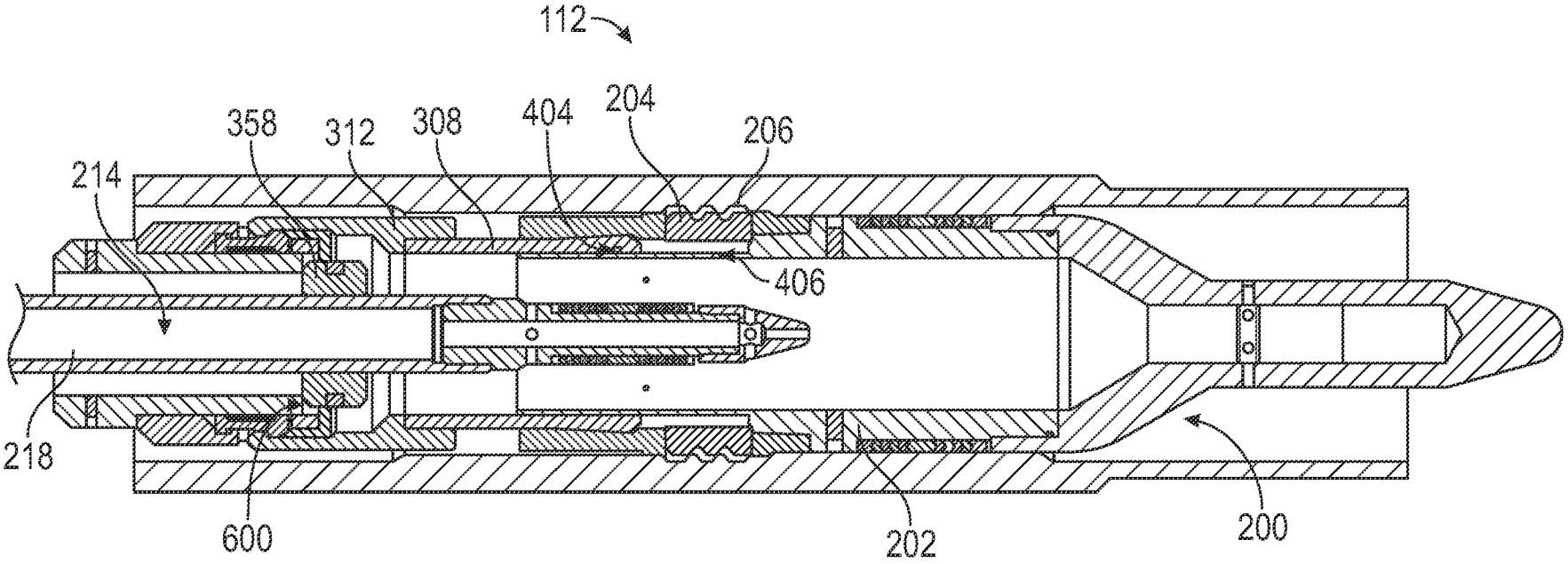
FIG. 6 illustrates a cross-sectional view of a downhole locking system in a released position, in accordance with some embodiments of the present disclosure.

FIG. 6 illustrates a cross-sectional view of a downhole locking system 112 in a released position, in accordance with some embodiments of the present disclosure. In the released position, the at least one key 204 is disengaged from the corresponding key slot 206 such that the lock mandrel 200 and prong 214 may be pulled out of hole (e.g., retrieved from the wellbore 114). The downhole locking system 112 moves to the released position in response to the setting and retrieving tool 222 (shown in FIG. 2) pulling the prong 214 uphole an additional second distance from the equalizing position, which may shear the setting shear member 404 such that key 204 may retract and disengage the lock mandrel 200 from the landing nipple 120.

As set forth above, the downhole locking system 112 includes the lower prong sleeve 358 secured about the tubular prong extension 218. As the tubular prong extension 218 moves axially upward from the set position toward the released position, the tubular prong extension 218 drives the lower prong sleeve 358 uphole into contact with a lower end 600 of the connector assembly 316, which drives the connector assembly 316 axially upward. Further, the connector assembly 316 may be secured to the expander sleeve 308 directly or via the fishing neck 312 such that uphole movement of the connector assembly 316 may pull the expander sleeve 308 to move axially uphole with respect to the tool mandrel 202. Moreover, as set forth above, the at least one setting shear member 404 is inserted into the corresponding setting slot 406 in the set position to hold the expander sleeve 308 in the set position. However, the axially uphole force applied to the expander sleeve 308, via the setting and retrieving tool 222, may shear the at least one setting shear member 404 to release the expander sleeve 308 to slide axially upward such that the at least one key 204 may disengage from the corresponding key slot 206 in the landing nipple 120. With the at least one key 204 disengaged, the lock mandrel 200 and prong 214 may be retrieved from the wellbore 114.

Figure 7:
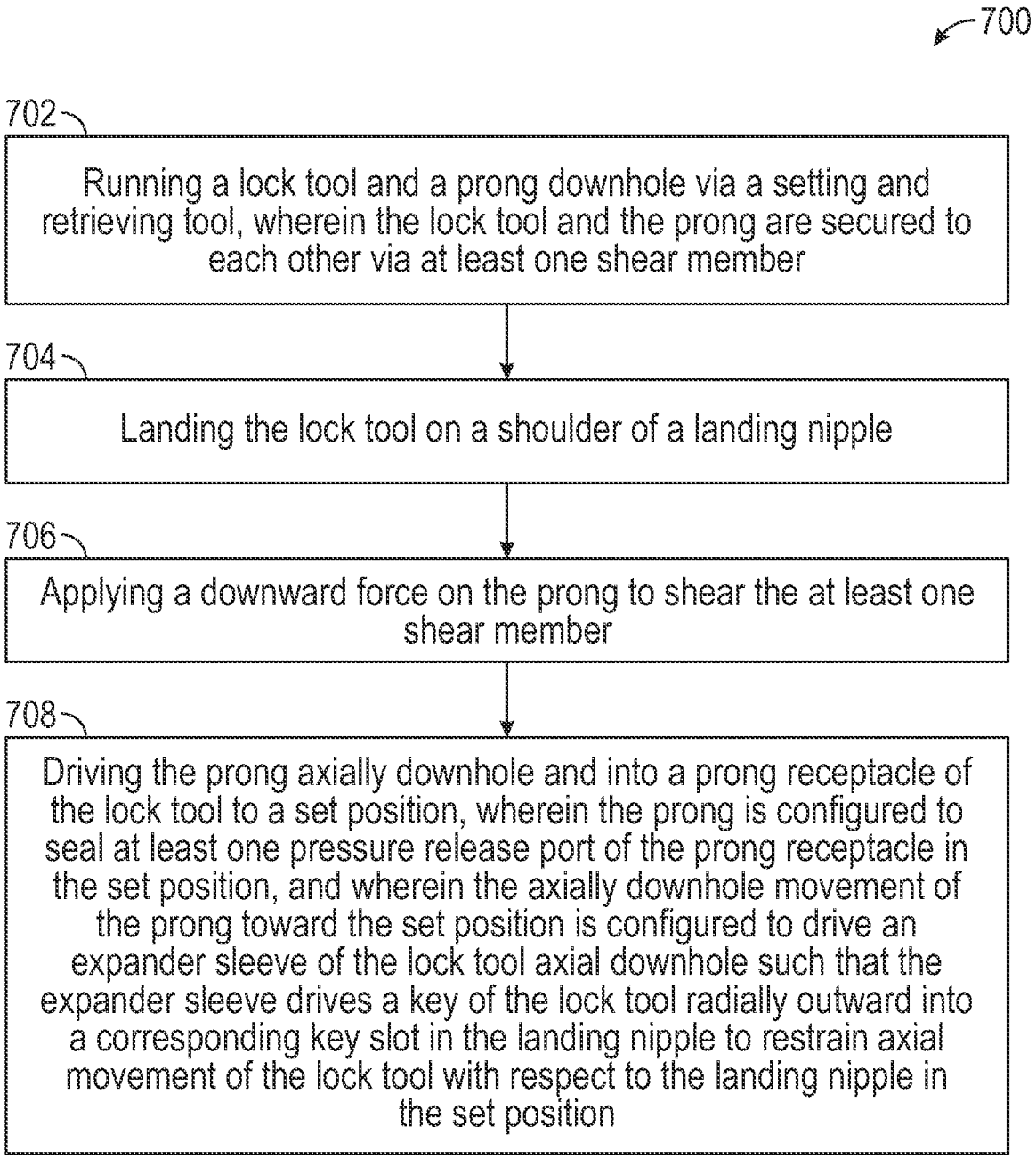
FIG. 7 illustrates a flow chart of a method for setting and retrieving the lock mandrel and prong, in accordance with some embodiments of the present disclosure.

FIG. 7 illustrates a flow chart of a method 700 for setting and retrieving the lock mandrel and prong, in accordance with some embodiments of the present disclosure. As illustrated, the method for setting and retrieving a downhole locking tool includes the step 702 of running a lock mandrel and a prong downhole via a setting and retrieving tool. As set forth above, the lock mandrel and the prong a secured to each other via at least one shear member. Further, the method also includes the step 704 of landing the lock mandrel on a shoulder of a landing nipple. Additionally, the method further includes the step 706 of applying a downward force on the prong to shear the at least one shear member. Moreover, the method includes the step 708 of driving the prong axially downhole and into a prong receptacle of the lock mandrel to a set position. The prong is configured to seal at least one pressure release port of the prong receptacle in the set position, and the axially downhole movement of the prong toward the set position is configured to drive an expander sleeve of the lock mandrel axial downhole such that the expander sleeve drives a key of the lock mandrel radially outward into a corresponding key slot in the landing nipple to restrain axial movement of the lock mandrel with respect to the landing nipple in the set position.

In some embodiments, the method 700 may further include the step of pulling the prong axially uphole via the setting and retrieving tool to unseal the pressure release port and shear an expander sleeve shear member such that key may retract and disengage the lock mandrel from the landing nipple. The setting and retrieving tool is configured to pull the prong uphole a first distance to unseal the pressure release port, and wherein the setting and retrieving to is configured hold wait a determined period of time such that uphole and downhole pressure, with respect to the lock mandrel, may at least partially equalize. Additionally, the setting and retrieving tool is configured to pull the prong uphole an additional second distance after the determined period of time to shear a setting shear member such that key may retract and disengage the lock mandrel from the landing nipple.

Accordingly, the present disclosure may provide a downhole locking system for installing a lock mandrel and prong to a landing nipple in a single trip. The methods and systems may include any of the various features disclosed herein, including one or more of the following statements.

Statement 1. A system, comprising: a tool mandrel securable to a landing nipple; a prong receptacle coupled to a lower end of the tool mandrel, the prong receptacle comprising a central bore and a pressure release port in communication with the central bore; an equalizing prong initially securable within the tool mandrel in a run-in position; and a tubular prong extension coupled to the equalizing prong, wherein an upper end of the tubular prong extension extends up out of the tool mandrel, and wherein axially downward movement of the tubular prong extension from the run-in position to a set position secures the tool mandrel to the landing nipple, and wherein axially upward movement of the tubular prong extension from the set position to a released position disengages the tool mandrel from the landing nipple.

Statement 2. The system of statement 1, wherein the pressure release port is open in the run-in position, wherein axially downward movement of the tubular prong extension from the run-in position to a set position moves the equalizing prong along the central bore to the set position to block the pressure release port, and wherein axially upward movement of the tubular prong extension from the set position to a released position pulls the equalizing prong uphole to open the pressure release port.

Statement 3. The system of statement 1 or statement 2, further comprising: at least one key disposed about the tool mandrel and radially moveable into a corresponding key slot in the landing nipple to secure the tool mandrel to the landing nipple; an expander sleeve slideable along the tool mandrel from the run-in position to the set position to drive the at least one key radially outward into the corresponding key slot; a connector assembly secured to the expander sleeve, wherein the axially downward movement of the tubular prong extension from the run-in position to a set position drives the connector assembly into the expander sleeve such that the expander sleeve slides axially downward to the set position and drives the at least one key radially outward into the corresponding key slot.

Statement 4. The system of statement 3, wherein moving the tubular prong extension axially upward from the set position to the released position drives the connector assembly axially upward, wherein axially upward movement of the connector assembly pulls the expander sleeve axially upward such that the at least one key disengages from the corresponding key slot in the landing nipple.

Statement 5. The system of statement 3 or statement 4, wherein the expander sleeve comprises at least one setting shear member, wherein the tool mandrel comprises at least one corresponding setting slot, wherein the at least one setting shear member is inserted into the corresponding setting slot in the set position to hold the expander sleeve in the set position, and wherein axially upward movement of the connector assembly is configured to shear the at least one setting shear member to release the expander sleeve to slide axially upward.

Statement 6. The system of any of statements 3-5, further comprising an upper prong sleeve secured about the tubular prong extension and attached to the connector assembly in the run-in position, via at least one upper shear member, such that the tubular prong extension is releasably secured to the connector assembly via the upper prong sleeve.

Statement 7. The system of any of statements 3-6, wherein the upper prong sleeve comprises an upper prong shoulder formed at a transition between an upper portion and a lower portion of the upper prong sleeve, wherein axially downward movement of the tubular prong extension from the run-in position to a set position is configured to shear the at least one upper shear member to detach the upper prong sleeve from the connector assembly, and wherein and wherein the upper prong shoulder is configured to contact an upper end of the connector assembly to drive the connector assembly axially into the expander sleeve.

Statement 8. The system of any of statements 3-7, further comprising a lower prong sleeve secured about the tubular prong extension and attached to the tool mandrel in the run-in position, via at least one lower shear member, such that the tubular prong extension is releasably secured to the tool mandrel via the lower prong sleeve.

Statement 9. The system of any of statements 3-8, wherein axially downward movement of the tubular prong extension from the run-in position to a set position is configured to shear the at least one lower shear member to detach the lower prong sleeve from the tool mandrel, and wherein axially upward movement of the tubular prong extension from the set position to the released position is configured to move the lower prong sleeve upward into contact with a lower end of the connector assembly to drive the connector assembly axially upward such that the at least one key disengages from the corresponding key slot in the landing nipple.

Statement 10. The system of any of statements 3-9, further comprising a fishing neck coupled to an upper end of the expander sleeve, wherein the connector assembly is secured to the expander sleeve via the fishing neck.

Statement 11. The system of any of statements 3-10, wherein the connector assembly and the fishing neck are a single component.

Statement 12. The system of any of statements 3-10, wherein the connector assembly comprises: an inner connector sleeve secured to the tubular prong extension in the running position; an outer connector sleeve with a lower lip interfaced with a lower end of a fishing lip of the fishing neck; a connector retainer disposed about the inner connector sleeve, wherein the connector retainer has an inner profile for at least partially housing the outer connector sleeve, and wherein the connector retainer comprises an upper retainer shoulder interfaced with an upper end of the fishing lip such that the upper retainer shoulder and the lower lip secure the connector assembly to the fishing neck.

Statement 13. The system of any preceding statement, further comprising a key retainer secured to an exterior surface of the tool mandrel and configured to house the at least one key.

Statement 14. The system of any preceding statement, wherein the key retainer comprises a key shoulder configured to engage a no-go shoulder of the landing nipple to restrain downhole movement of the tool mandrel with respect to the landing nipple.

Statement 15. The system of any preceding statement, wherein between twenty to eighty percent of a total length of the tubular prong extension extends axially uphole from the connector assembly in the run-in position.

Statement 16. The system of any preceding statement, further comprising a coupling feature rigidly secured to an upper end of the tubular prong extension.

Statement 17. The system of any preceding statement, further comprising a setting and retrieving tool couplable to an exterior surface of the coupling feature, wherein the setting and retrieving tool is configured to drive the coupling feature axially downhole to move the tubular prong extension to the set position, wherein the setting and retrieving tool is configured to pull the coupling feature axially uphole a first distance to disengage the equalizing prong from the pressure release port, and wherein the setting and retrieving tool is configured to pull coupling feature axially uphole a second distance to disengage the tool mandrel from the landing nipple and move the tubular prong extension to the released position.

Statement 18. A method for setting and retrieving a downhole locking system, comprising: running a lock mandrel and a prong downhole via a setting and retrieving tool, wherein the lock mandrel and the prong are secured to each other via at least one shear member; landing the lock mandrel on a shoulder of a landing nipple; applying a downward force on the prong to shear the at least one shear member; and driving the prong axially downhole and into a prong receptacle of the lock mandrel to a set position, wherein the prong is configured to seal at least one pressure release port of the prong receptacle in the set position, and wherein the axially downhole movement of the prong toward the set position is configured to drive an expander sleeve of the lock mandrel axial downhole such that the expander sleeve drives a key of the lock mandrel radially outward into a corresponding key slot in the landing nipple to restrain axial movement of the lock mandrel with respect to the landing nipple in the set position.

Statement 19. The method of statement 18, further comprising pulling the prong axially uphole via the setting and retrieving tool to unseal the pressure release port and shear a setting shear member such that key may retract and disengage the lock mandrel from the landing nipple.

Statement 20. The method of statement 18 or statement 19, wherein the setting and retrieving tool is configured to pull the prong uphole a first distance to unseal the pressure release port, and wherein the setting and retrieving to is configured hold wait a determined period of time such that uphole and downhole pressure, with respect to the lock mandrel, may at least partially equalize, and wherein the setting and retrieving tool is configured to pull the prong uphole an additional second distance after the determined period of time to shear a setting shear member such that key may retract and disengage the lock mandrel from the landing nipple.

Statement 21. A system, comprising: a tool mandrel securable to a landing nipple; at least one key disposed about the tool mandrel and radially moveable into a corresponding key slot in the landing nipple to secure the tool mandrel to the landing nipple in a set position; an expander sleeve slidable along the tool mandrel toward the set position to drive the at least one key radially outward into the corresponding key slot; a connector assembly secured to the expander sleeve such that movement of the connector assembly slides the expander sleeve; a prong receptacle coupled to a lower end of the tool mandrel, the prong receptacle comprising a central bore and a pressure release port in communication with the central bore; an equalizing prong initially securable within the tool mandrel in a run-in position with the pressure release port on the prong receptacle initially open; a tubular prong extension coupled to the equalizing prong, wherein an upper end of the tubular prong extension extends up out of the tool mandrel, wherein the tubular prong extension is interfaceable with the connector assembly, wherein axially downward movement of the tubular prong extension from the run-in position to a set position drives the connector assembly downhole to secure the tool mandrel to the landing nipple and moves the equalizing prong along the central bore from the run-in position to the set position to block the pressure release port, and wherein axially upward movement of the tubular prong extension from the set position to a released position pulls the equalizing prong uphole to open the pressure release port and drives the connector assembly uphole to pull the expander sleeve and retract the at least one keys such that the tool mandrel disengages from the landing nipple; and a coupling feature rigidly secured to the uphole end of the tubular prong extension, wherein an exterior surface of the coupling feature is engageable with a setting and retrieving tool.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A system, comprising:

a tool mandrel securable to a landing nipple;

at least one key disposed about the tool mandrel and radially moveable into a corresponding key slot in the landing nipple to secure the tool mandrel to the landing nipple;

a prong receptacle coupled to a lower end of the tool mandrel, the prong receptacle comprising a central bore and a pressure release port in communication with the central bore;

an equalizing prong initially securable within the tool mandrel in a run-in position;

an expander sleeve slideable along the tool mandrel from the run-in position to the set position to drive the at least one key radially outward into the corresponding key slot;

a connector assembly secured to the expander sleeve; and a tubular prong extension coupled to the equalizing prong, wherein an upper end of the tubular prong extension extends up out of the tool mandrel, and wherein axially downward movement of the tubular prong extension from the run-in position to a set position drives the connector assembly into the expander sleeve such that the expander sleeve slides axially downward to the set position and drives the at least one key radially outward into the corresponding key slot to secure the tool mandrel to the landing nipple, and wherein axially upward movement of the tubular prong extension from the set position to a released position disengages the tool mandrel from the landing nipple.

2. The system of claim 1, wherein moving the tubular prong extension axially upward from the set position to the released position drives the connector assembly axially upward, wherein axially upward movement of the connector assembly pulls the expander sleeve axially upward such that the at least one key disengages from the corresponding key slot in the landing nipple.

3. The system of claim 1, wherein the expander sleeve comprises at least one setting shear member, wherein the tool mandrel comprises at least one corresponding setting slot, wherein the at least one setting shear member is inserted into the corresponding setting slot in the set position to hold the expander sleeve in the set position, and wherein axially upward movement of the connector assembly is configured to shear the at least one setting shear member to release the expander sleeve to slide axially upward.

4. The system of claim 1, further comprising an upper prong sleeve secured about the tubular prong extension and attached to the connector assembly in the run-in position, via at least one upper shear member, such that the tubular prong extension is releasably secured to the connector assembly via the upper prong sleeve.

5. The system of claim 4, wherein the upper prong sleeve comprises an upper prong shoulder formed at a transition between an upper portion and a lower portion of the upper prong sleeve, wherein axially downward movement of the tubular prong extension from the run-in position to a set position is configured to shear the at least one upper shear member to detach the upper prong sleeve from the connector assembly, and wherein the upper prong shoulder is configured to contact an upper end of the connector assembly to drive the connector assembly axially into the expander sleeve.

6. The system of claim 1, further comprising a lower prong sleeve secured about the tubular prong extension and attached to the tool mandrel in the run-in position, via at least one lower shear member, such that the tubular prong extension is releasably secured to the tool mandrel via the lower prong sleeve.

7. The system of claim 6, wherein axially downward movement of the tubular prong extension from the run-in position to a set position is configured to shear the at least one lower shear member to detach the lower prong sleeve from the tool mandrel, and wherein axially upward movement of the tubular prong extension from the set position to the released position is configured to move the lower prong sleeve upward into contact with a lower end of the connector assembly to drive the connector assembly axially upward such that the at least one key disengages from the corresponding key slot in the landing nipple.

8. The system of claim 1, further comprising a fishing neck coupled to an upper end of the expander sleeve, wherein the connector assembly is secured to the expander sleeve via the fishing neck.

9. The system of claim 8, wherein the connector assembly and the fishing neck are a single component.

10. The system of claim 8, wherein the connector assembly comprises:

an inner connector sleeve secured to the tubular prong extension in the running position;

an outer connector sleeve with a lower lip interfaced with a lower end of a fishing lip of the fishing neck;

a connector retainer disposed about the inner connector sleeve, wherein the connector retainer has an inner profile for at least partially housing the outer connector sleeve, and wherein the connector retainer comprises an upper retainer shoulder interfaced with an upper end of the fishing lip such that the upper retainer shoulder and the lower lip secure the connector assembly to the fishing neck.

11. The system of claim 1, further comprising a key retainer secured to an exterior surface of the tool mandrel and configured to house the at least one key.

12. The system of claim 11, wherein the key retainer comprises a key shoulder configured to engage a no-go shoulder of the landing nipple to restrain downhole movement of the tool mandrel with respect to the landing nipple.

13. The system of claim 1, wherein between twenty to eighty percent of a total length of the tubular prong extension extends axially uphole from the connector assembly in the run-in position.

14. The system of claim 1, further comprising a coupling feature rigidly secured to an upper end of the tubular prong extension.

15. The system of claim 14, further comprising a setting and retrieving tool couplable to an exterior surface of the coupling feature, wherein the setting and retrieving tool is configured to drive the coupling feature axially downhole to move the tubular prong extension to the set position, wherein the setting and retrieving tool is configured to pull the coupling feature axially uphole a first distance to disengage the equalizing prong from the pressure release port, and wherein the setting and retrieving tool is configured to pull the coupling feature axially uphole a second distance to disengage the tool mandrel from the landing nipple and move the tubular prong extension to the released position.

16. The system of claim 1, wherein the pressure release port is open in the run-in position, wherein axially downward movement of the tubular prong extension from the run-in position to the set position moves the equalizing prong along the central bore to the set position to block the pressure release port, and wherein axially upward movement of the tubular prong extension from the set position to the released position pulls the equalizing prong uphole to open the pressure release port.

17. A system, comprising:

a tool mandrel securable to a landing nipple;

a prong receptacle coupled to a lower end of the tool mandrel, the prong receptacle comprising a central bore and a pressure release port in communication with the central bore, wherein the pressure release port is open in the run-in position;

an equalizing prong initially securable within the tool mandrel in a run-in position; and a tubular prong extension coupled to the equalizing prong, wherein an upper end of the tubular prong extension extends up out of the tool mandrel, wherein axially downward movement of the tubular prong extension from the run-in position to a set position moves the equalizing prong along the central bore to the set position to block the pressure release port and secures the tool mandrel to the landing nipple, and wherein axially upward movement of the tubular prong extension from the set position to a released position pulls the equalizing prong uphole to open the pressure release port and disengages the tool mandrel from the landing nipple.

18. A method for setting and retrieving a downhole locking system, comprising:

running a lock mandrel and a prong downhole via a setting and retrieving tool, wherein the lock mandrel and the prong are secured to each other via at least one shear member;

landing the lock mandrel on a shoulder of a landing nipple;

applying a downward force on the prong to shear the at least one shear member; and driving the prong axially downhole and into a prong receptacle of the lock mandrel to a set position, wherein the prong is configured to seal at least one pressure release port of the prong receptacle in the set position, and wherein the axially downhole movement of the prong toward the set position is configured to drive an expander sleeve of the lock mandrel axial downhole such that the expander sleeve drives a key of the lock mandrel radially outward into a corresponding key slot in the landing nipple to restrain axial movement of the lock mandrel with respect to the landing nipple in the set position; and pulling the prong axially uphole via the setting and retrieving tool to unseal the pressure release port and shear a setting shear member such that key retracts and disengages the lock mandrel from the landing nipple.

19. The method of claim 18, wherein the setting and retrieving tool is configured to pull the prong uphole a first distance to unseal the pressure release port, wherein the setting and retrieving to is configured to wait a determined period of time such that uphole and downhole pressure, with respect to the lock mandrel, at least partially equalizes, and wherein the setting and retrieving tool is configured to pull the prong uphole an additional second distance after the determined period of time to shear the setting shear member such that key retracts and disengages the lock mandrel from the landing nipple.

20. A system, comprising:

a tool mandrel securable to a landing nipple;

at least one key disposed about the tool mandrel and radially moveable into a corresponding key slot in the landing nipple to secure the tool mandrel to the landing nipple in a set position;

an expander sleeve slidable along the tool mandrel toward the set position to drive the at least one key radially outward into the corresponding key slot;

a connector assembly secured to the expander sleeve such that movement of the connector assembly slides the expander sleeve;

a prong receptacle coupled to a lower end of the tool mandrel, the prong receptacle comprising a central bore and a pressure release port in communication with the central bore;

an equalizing prong initially securable within the tool mandrel in a run-in position with the pressure release port on the prong receptacle initially open;

a tubular prong extension coupled to the equalizing prong, wherein an upper end of the tubular prong extension extends up out of the tool mandrel, wherein the tubular prong extension is interfaceable with the connector assembly, wherein axially downward movement of the tubular prong extension from the run-in position to a set position drives the connector assembly downhole to secure the tool mandrel to the landing nipple and moves the equalizing prong along the central bore from the run-in position to the set position to block the pressure release port, and wherein axially upward movement of the tubular prong extension from the set position to a released position pulls the equalizing prong uphole to open the pressure release port and drives the connector assembly uphole to pull the expander sleeve and retract the at least one keys such that the tool mandrel disengages from the landing nipple; and a coupling feature rigidly secured to the uphole end of the tubular prong extension, wherein an exterior surface of the coupling feature is engageable with a setting and retrieving tool.

* * * * *